US006280140B1

(12) United States Patent
Soechting et al.

(10) Patent No.: US 6,280,140 B1
(45) Date of Patent: Aug. 28, 2001

(54) METHOD AND APPARATUS FOR COOLING AN AIRFOIL

(75) Inventors: Friedrich O. Soechting, Tequesta, FL (US); William A. Kvasnak, Guilford, CT (US); Thomas A. Auxier, Palm Beach Gardens; James P. Downs, Jupiter, both of FL (US); William H. Calhoun, Akworth, GA (US); Douglas A. Hayes, Port St. Lucie, FL (US)

(73) Assignee: United Technologies Corporation, Hartford, CT (US)

( * ) Notice: Subject to any disclaimer, the term of this patent is extended or adjusted under 35 U.S.C. 154(b) by 0 days.

(21) Appl. No.: 09/442,922

(22) Filed: Nov. 18, 1999

(51) Int. Cl.[7] ..... F01D 5/18
(52) U.S. Cl. ..... 416/97 R
(58) Field of Search ..... 416/97 R, 97 A, 416/96 A, 96 R; 415/115, 116, 914

(56) References Cited

U.S. PATENT DOCUMENTS

| | | | |
|---|---|---|---|
| 3,672,787 | 6/1972 | Thorstenson | 416/97 |
| 3,698,834 | 10/1972 | Meginnis | 416/96 |
| 4,292,376 | 9/1981 | Hustler | 428/593 |
| 4,314,442 | 2/1982 | Rice | 60/39.05 |
| 4,653,983 | 3/1987 | Vehr | 416/97 R |
| 4,664,597 | 5/1987 | Auxier et al. | 416/97 R |
| 4,669,957 | 6/1987 | Phillips et al. | 416/97 R |
| 4,676,719 | 6/1987 | Auxier et al. | 416/97 R |
| 4,726,735 | 2/1988 | Field et al. | 416/97 R |
| 5,342,172 | 8/1994 | Coudray et al. | 416/97 R |
| 5,383,766 * | 1/1995 | Przirembel et al. | 416/97 A |
| 5,392,515 | 2/1995 | Auxier et al. | 29/889.721 |
| 5,405,242 | 4/1995 | Auxier et al. | 415/115 |
| 5,419,039 * | 5/1995 | Auxier et al. | 29/889.721 |
| 5,419,681 | 5/1995 | Lee | 416/97 R |
| 5,458,461 | 10/1995 | Lee et al. | 416/97 R |
| 5,626,462 | 5/1997 | Jackson et al. | 416/97 R |

FOREIGN PATENT DOCUMENTS

| | | |
|---|---|---|
| 2 061 729 | 6/1971 | (DE) . |
| 29 42 815 | 5/1980 | (DE) . |
| 1 285 369 | 8/1972 | (GB) . |

* cited by examiner

*Primary Examiner*—Edward K. Look
*Assistant Examiner*—James M McAleenan
(74) *Attorney, Agent, or Firm*—Richard D. Getz

(57) ABSTRACT

An apparatus and method for cooling a wall for use in a gas turbine engine is provided that includes a cooling air passage having a plurality of segments connected in series by one or more chambers, an inlet aperture, and an exit aperture. The inlet aperture connects the cooling air passage to one side of the wall. The exit aperture connects the cooling air passage to the opposite side of the wall. Cooling air on the inlet aperture side of the wall enters the cooling air passage through the inlet aperture and exits through the exit aperture.

21 Claims, 3 Drawing Sheets

METHOD AND APPARATUS FOR COOLING AN AIRFOIL

BACKGROUND OF THE INVENTION

1. Technical Field

This invention relates to gas turbine engines in general, and to methods and apparatus for cooling a substrate exposed to high temperature gas in particular.

2. Background Information

Efficiency is a primary concern in the design of any gas turbine engine. Historically, one of the principle techniques for increasing efficiency has been to increase the core gas path temperatures within the engine. Core gas refers to air worked within the compressor that is mixed with fuel and combusted within the combustor. The increased gas path temperatures have been accommodated by using internally cooled components made from high temperature capacity alloys. Turbine stator vanes and blades, for example, are typically cooled using compressor air worked to a higher pressure, but still at a lower temperature than that of the core gas flow passing by the blade or vane. The higher pressure provides the energy necessary to push the air through the component. A significant percentage of the work imparted to the air bled from the compressor, however, is lost during the cooling process. The lost work does not add to the thrust of the engine and therefore negatively effects the overall efficiency of the engine. A person of skill in the art will recognize, therefore, that there is a tension between the efficiency gained from higher core gas path temperatures and the concomitant need to cool turbine components and the efficiency lost from bleeding air to perform that cooling.

There is, accordingly, great value in maximizing the cooling effectiveness of whatever cooling air is used. Prior art coolable airfoils typically include a plurality of internal cavities, which are supplied with cooling air. The cooling air passes through the wall of the airfoil (or the platform) and transfers thermal energy away from the airfoil in the process. The manner in which the cooling air passes through the airfoil wall is critical to the efficiency of the process. In some instances, cooling air is passed through straight or diffused cooling apertures to convectively cool the wall and establish an external film of cooling air. A minimal pressure drop is typically required across these type cooling apertures to minimize the amount of cooling air that is immediately lost to the free-stream hot core gas passing by the airfoil. The minimal pressure drop is usually produced through a plurality of cavities within the airfoil connected by a plurality of metering holes. Too small a pressure drop across the airfoil wall can result in undesirable hot core gas in-flow. In all cases, the minimal dwell time in the cooling aperture as well as the size of the cooling aperture make this type of convective cooling relatively inefficient.

Some airfoils convectively cool by passing cooling air through passages disposed within a wall or platform. Typically, those passages extend a significant distance within the wall or platform along a substantially straight line. There are several potential problems with this type of cooling scheme. First, the heat transfer rate between the passage walls and the cooling air decreases markedly as a function of distance traveled within the passage. As a result, cooling air flow adequately cooling the beginning of the passage may not adequately cool the end of the passage. If the cooling air flow is increased to provide adequate cooling at the end of the passage, the beginning of the passage may be excessively cooled, consequently wasting cooling air. Second, the thermal profile of an airfoil is typically non-uniform and will contain regions exposed to a greater or lesser thermal load. The prior art internal cooling passages extending a significant distance within an airfoil wall or a platform typically span one or more regions having disparate thermal loads. Similar to the situation described above, providing a cooling flow adequate to cool the region with the greatest thermal load can result in other regions along the passage being excessively cooled.

What is needed, therefore, is a method and apparatus for cooling a substrate within gas turbine engine that adequately cools the substrate using a minimal amount of cooling air and one that provides heat transfer where it is needed.

DISCLOSURE OF THE INVENTION

It is, therefore, an object to provide a method and an apparatus for cooling a wall within a gas turbine engine for removing more cooling potential from cooling air passed through the wall than is possible using most conventional methods and apparatus.

It is another object to provide a method for cooling a wall within a gas turbine engine that can produce a cooling profile that substantially matches the thermal profile of the wall, and an apparatus that can be used for the same.

According to the present invention, an apparatus and a method for cooling a wall for use in a gas turbine engine is provided that includes a cooling microcircuit. The cooling microcircuit, which can be disposed within the wall of a component such as a stator vane or a rotor blade, includes passage having a plurality of segments connected in series by one or more chambers. An inlet aperture connects the passage to one side of the wall. An exit aperture connects the passage to the opposite side of the wall. Cooling air on the inlet aperture side of the wall enters the passage through the inlet aperture and exits through the exit aperture.

The present cooling apparatus and method for cooling a wall provides significantly increased cooling effectiveness over prior art cooling schemes. One of the ways the present apparatus and method provides increased cooling effectiveness is by increasing the heat transfer coefficient per unit flow within a cooling passage. The transfer of thermal energy between the wall containing the passage and the cooling air is directly related to the heat transfer coefficient within the passage for a given flow. A velocity profile of fluid flow adjacent each wall of a passage is characterized by an initial hydrodynamic entrance region and a subsequent fully developed region as can be seen in FIG.7. In the entrance region, a fluid flow boundary layer develops adjacent the walls of the passage, starting at zero thickness at the passage entrance and eventually becoming a constant thickness at some position downstream within the passage. The change to constant thickness marks the beginning of the fully developed flow region. The heat transfer coefficient is at a maximum when the boundary layer thickness is equal to zero, decays as the boundary layer thickness increases, and becomes constant when the boundary layer becomes constant. Hence, for a given flow the average heat transfer coefficient in the entrance region is higher than the heat transfer coefficient in the fully developed region. The present apparatus and method increases the percentage of flow in a passage characterized by entrance region effects by providing a plurality of short length segments connected by chambers. Fluid entering a chamber diffuses and decreases in velocity. Fluid exiting a chamber is characterized by entrance region effects and consequent increased local heat transfer coefficients. The average heat transfer coefficient per unit flow of the relatively short segments of the present apparatus and method is consequently higher than that available in all similar prior art cooling schemes of which we are aware.

Another way the present invention provides an increased cooling effectiveness also involves the short length segment between chambers. The relationship between the beat transfer rate and the heat transfer coefficient in given length of passage can be mathematically described as follows:

$$q=h_c A_s \Delta T_{lm} \quad \text{(Eqn. 1)}$$

where:

q=heat transfer rate between the passage and the fluid $h_c$=heat transfer coefficient of the passage $A_s$=passage surface area =P×L=Passage perimeter×length $\Delta T_{lm}$=log mean temperature difference The above equation illustrates the direct relationship between the heat transfer rate and the heat transfer coefficient, as well the relationship between the heat transfer rate and the difference in temperature between the passage surface temperature and the inlet and exit fluid temperatures passing through a length of passage (i.e., $\Delta T_{lm}$). In particular, if the passage surface temperature is held constant (a reasonable assumption for a given length of passage within an airfoil, for example) the temperature difference between the passage surface and the fluid decays exponentially as a function of distance traveled through the passage. The consequent exponential decay of the heat transfer rate is particularly significant in the fully developed region where the heat transfer coefficient is constant and the heat transfer rate is dependent on the difference in temperature. The present apparatus and method use relatively short length segments disposed between chambers. As stated above, cooling airflow passing through a portion of each segment is characterized by an entrance region velocity profile and the remainder is characterized by a fully developed velocity profile under normal operating conditions. In all embodiments of the present apparatus and method, the segment length between chambers is short to minimize the effect of the exponentially decaying heat transfer rate attributable to temperature difference, particularly in the fully developed region.

In some embodiments, the present apparatus and method includes a number of segments successively shorter in length. The longest of the successively shorter segments is positioned adjacent the inlet aperture where the temperature difference between the fluid temperature and the passage wall is greatest, and the shortest of the successively shorter segments is positioned adjacent the exit aperture where the temperature difference between the fluid temperature and the passage wall is smallest. Successively decreasing the length of the segments within the passage helps to offset the decrease in $\Delta T_{lm}$, in each successive segment. For explanation sake, consider a plurality of same length segments, connected to one another in series. The average $\Delta T_{lm}$ of each successive segment will decrease because the cooling air increases in temperature as it travels through each segment. The average heat transfer rate, which is directly related to the $\Delta T_{lm}$, consequently decreases in each successive segment. Cooling air traveling through a plurality of successively shorter segments will also increase in temperature as it passes through successive segments. The amount that the $\Delta T_{lm}$ decreases per segment, however, is less in successively shorter segments (vs. equal length segments) because the length of the segment where the exponential temperature decay occurs is shorter. Hence, decreasing segment lengths positively influence the heat transfer rate by decreasing the influence of the exponential decaying temperature difference.

Another way the present invention provides an increased cooling effectiveness is by utilizing cooling air pressure difference in a manner that optimizes heat transfer within the passage. Convective heat transfer is a function of the Reynolds number and therefore the Mach number (i.e., velocity) of the cooling air traveling through a segment of the passage. In one embodiment of the present apparatus and method, cooling air is maintained at substantially the same Mach number in each segment by maintaining the substantially the same ratio of chamber pressures across each segment. The preferred manner for maintaining substantially the same ratio of chamber pressures across each segment is by altering the cross-sectional area of each successive segment within the passage.

The small size of the present cooling apparatus also provides advantages over many prior art cooling schemes. The thermal profile of most blades or vanes is typically non-uniform along its span and/or width. If the thermal profile is reduced to a plurality of regions however, and if the regions are small enough, each region can be considered as having a uniform heat flux. The non-uniform profile can, therefore, be described as a plurality of regions, each having a substantially uniform heat flux albeit different in magnitude. The present cooling microcircuits can be sized to fit within most of those regions of uniform heat flux. Consequently, an embodiment of the present microcircuit can be tuned and deployed to offset a particular magnitude heat flux present in a particular region. A blade or vane having a non-uniform thermal profile, for example, can be efficiently cooled with the present invention by positioning one or more microcircuits at particular locations within the blade or vane wall, and matching the cooling capacity of the microcircuit(s) to the local heat flux. As a result, excessive cooling is decreased and the cooling efficiency is increased.

The size of the present cooling microcircuit also provides cooling passage compartmentalization. Some conventional cooling passages include a long passage volume connected to the core gas side of the wall by a plurality of exit apertures. In the event a section of the passage is burned through, it is possible for a significant portion of the passage to be exposed to hot core gas in-flow through the plurality of exit apertures. The present apparatus and method limits the potential for hot core gas in-flow by preferably utilizing only one exit aperture per passage. In the event hot core gas in-flow does occur, the present passages are limited in area, consequently limiting the area potentially exposed to undesirable hot core gas.

These and other objects, features and advantages of the present invention will become apparent in light of the detailed description of the best mode embodiment thereof, as illustrated in the accompanying drawings.

DETAILED DESCRIPTION OF THE INVENTION

Figure 1:
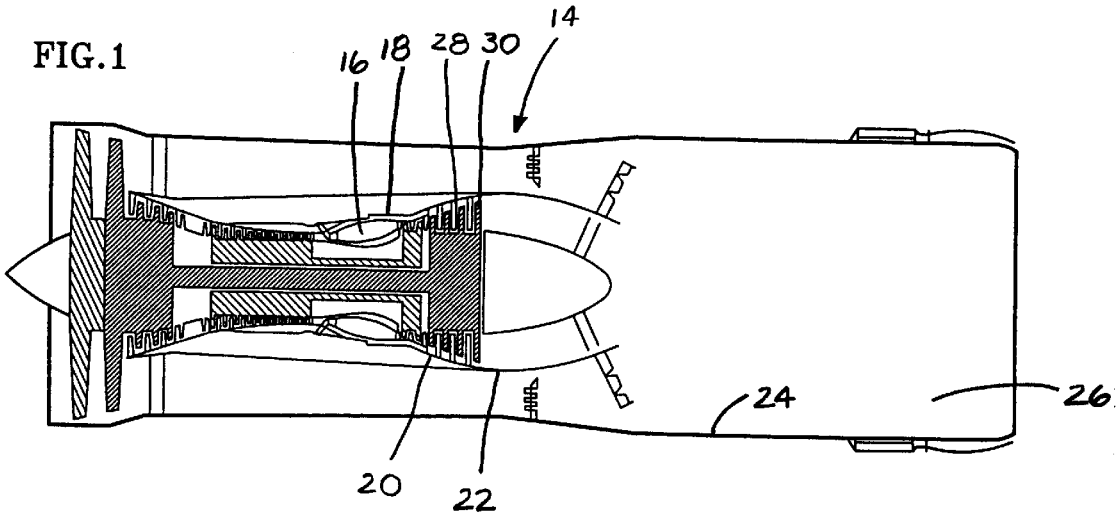
FIG. 1 is a diagrammatic view of a gas turbine engine.
Figure 2:
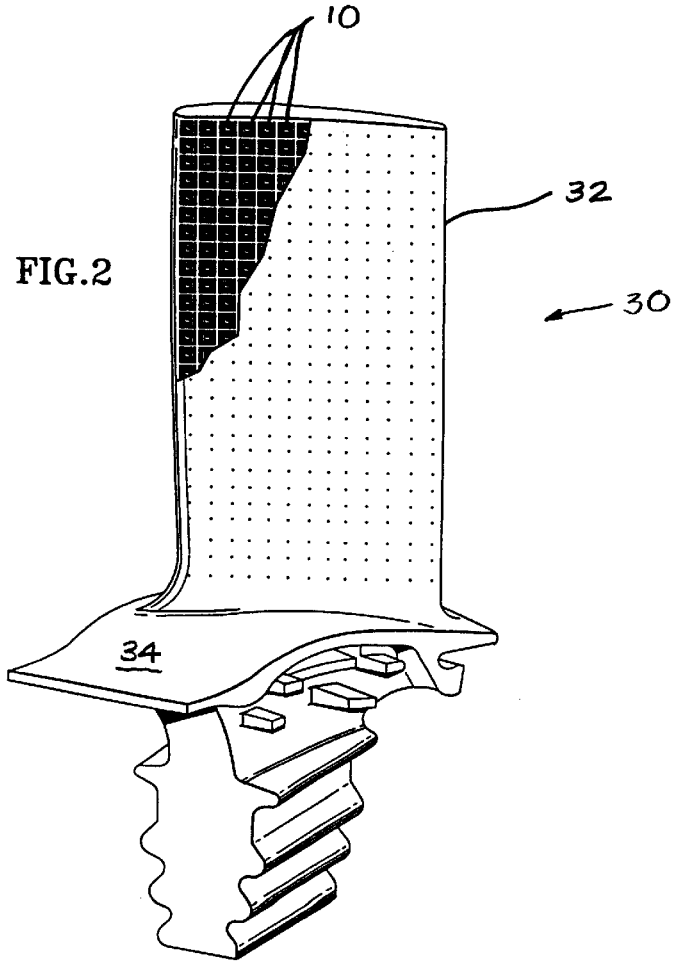
FIG. 2 is a diagrammatic view of a rotor blade having a plurality of the present invention cooling microcircuits disposed in a wall.
Figure 3:
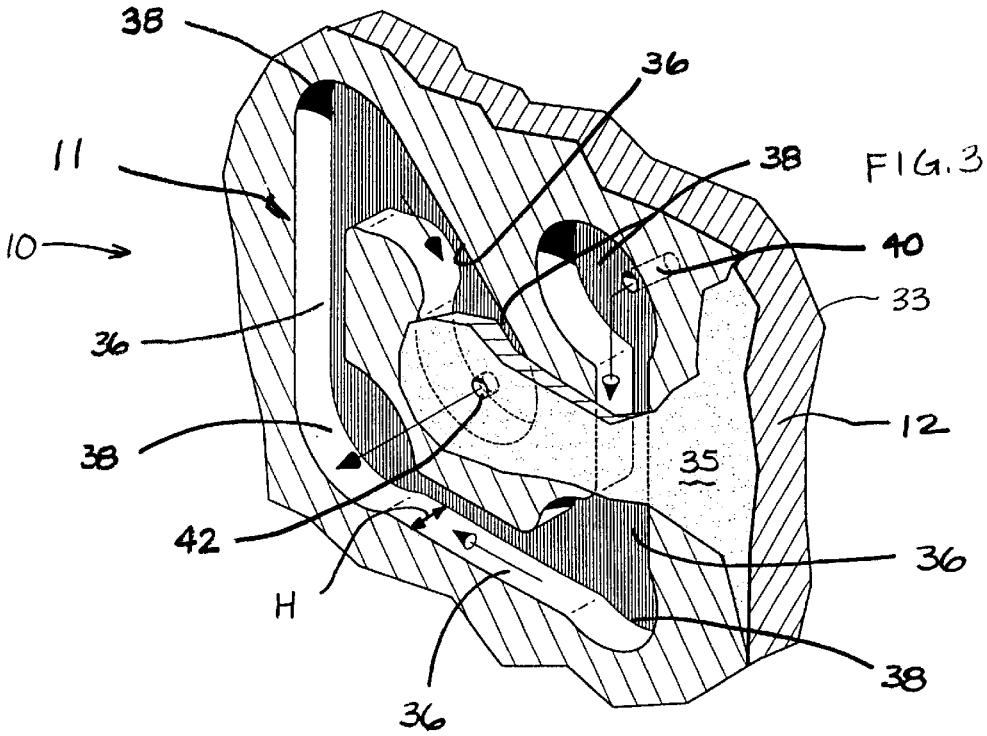
FIG. 3 is an enlarged diagrammatic perspective view of an embodiment of the present invention cooling microcircuit.

Referring to FIGS. 1–3, a cooling microcircuit 10 is disposed within a wall 12 exposed to hot core gas within a gas turbine engine 14. Cooling air is typically present on one side of the wall 12 and hot core gas is present on the opposite side of the wall 12 during operating conditions. Potential applications of the present invention microcircuit 10 include, but are not limited to, combustors 16 and combustor liners 18, blade outer air seals 20, turbine exhaust liners 22, augmentor liners 24, nozzles 26, stator vanes 28, and rotor blades 30. For purposes of providing a detailed description, the present microcircuit 10 will be described in the context of a rotor blade 30 application. FIG. 2 shows the microcircuit 10 disposed in an airfoil portion 32 of a turbine rotor blade 30, although the microcircuit 10 may also be disposed in the platform portion 34.

Referring to FIG. 3, a cooling microcircuit 10 is shown disposed in a wall 12 between a first surface 33 and a second surface 35 of the wall 12. Each microcircuit 10 embodiment includes a passage 11 consisting of a plurality of segments 36 connected in series by one or more chambers 38, an inlet aperture 40, and an exit aperture 42. Each chamber 38 has a cross-sectional flow area greater than the cross-sectional flow area of a segment 36. The cross-sectional flow of each chamber is great enough to cause cooling air flow exiting a segment 36 to diffuse and decrease in velocity, and great enough to cause flow exiting a chamber to nozzle and increase in velocity. The changes in cooling air velocity and the resultant changes in cooling air pressure across a segment 36 illustrate how the cooling air is metered within the segment 36. The inlet aperture 40 connects the passage 11 to one side of the wall 12. The exit aperture 42 connects the passage 11 to the opposite side of the wall 12. The inlet and exit apertures 40,42 may be disposed in a segment 36 or in a chamber 38. Cooling air on the inlet aperture side of the wall 12 enters the passage 11 through the inlet aperture 40 and exits through the exit aperture 42.

Each cooling microcircuit embodiment can occupy a wall surface area as great as 0.1 square inches (64.5 $mm^2$). It is more common, however, for a microcircuit 10 to occupy a wall surface area less than 0.06 square inches (38.7 $mm^2$), and the wall surface of preferred embodiments typically occupy a wall surface area closer to 0.01 square inches (6.45 $mm^2$). Passage segment size will vary depending upon the application, but in most embodiments the cross-sectional area of the segment 36 is less than 0.001 square inches (0.6 $mm^2$). The most preferred segment embodiments have a cross-sectional area between 0.0001 and 0.0006 square inches (0.064 $mm^2$ and 0.403 $mm^2$) with a substantially rectangular shape. For purposes of this disclosure, segment 36 (or chamber 38) cross-sectional area shall be defined as a cross-section taken along a plane substantially perpendicular to the direction of cooling airflow through the segment 36 (or chamber 38).

Figure 4:
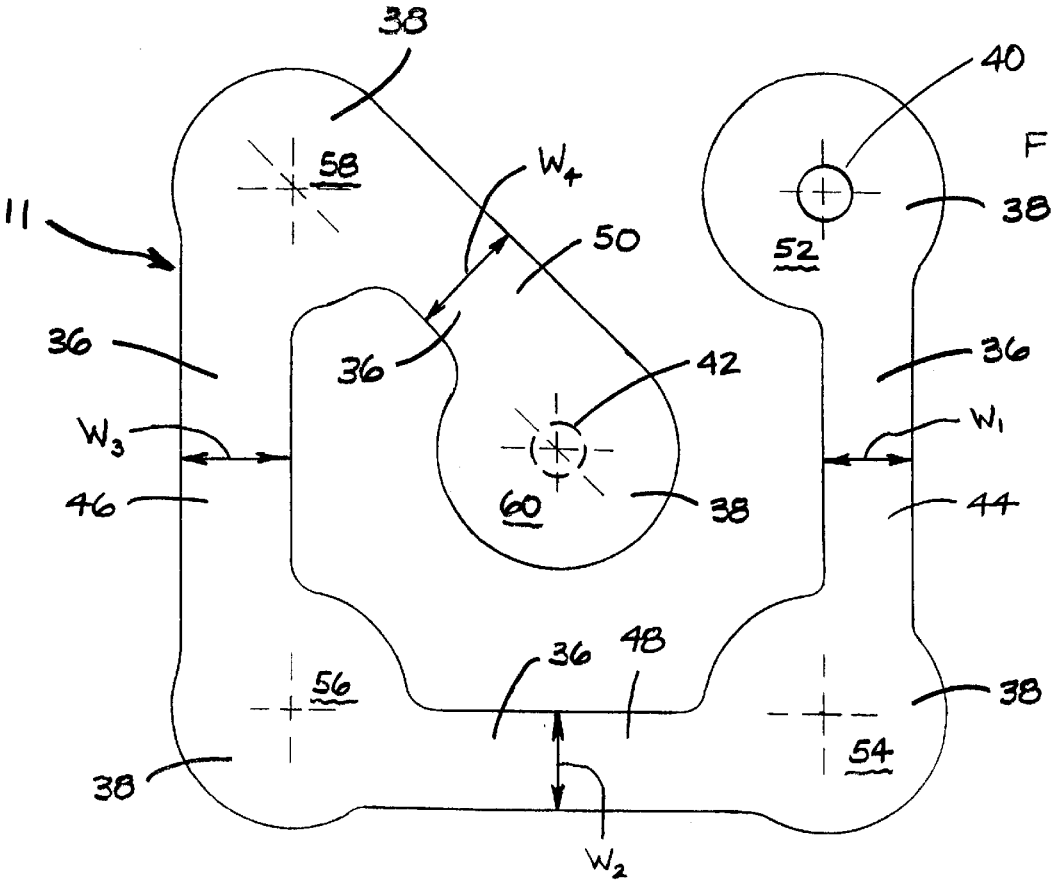
FIG. 4 is a diagrammatic planar view of the present invention cooling microcircuit embodiment shown in FIG. 3.

Referring to FIGS. 3 and 4, in one embodiment of the present microcircuit 10 the passage 11 includes a series of segments 36 connected by chambers 38, disposed in a spiral-like arrangement. The example of this embodiment shown in FIGS. 3 and 4, includes four segments 36 and five chambers 38. The first segment 44 and the third segment 46 are substantially parallel one another and connected via a second segment 48 that extends substantially perpendicular to the first and third segments 44,46. The fourth segment 50 extends into the area boxed by the first, second, and third segments 44,48,46, giving the microcircuit 10 its spiral-like configuration. The first chamber 52 is attached to one end of the first segment 44. The inlet aperture 40 is disposed in the first chamber 52, connecting the passage 11 to one side of the wall 12. The second chamber 54 connects the first and second segments 44,48, the third chamber 56 connects the second and third segments 48,46, and the fourth chamber 58 connects the third and fourth segments 46,50. The fifth chamber 60 is attached to the end of the fourth segment 50. The exit aperture 42 is disposed in the fifth chamber 60, connecting the passage 11 to the opposite side of the wall 12.

Figure 5:
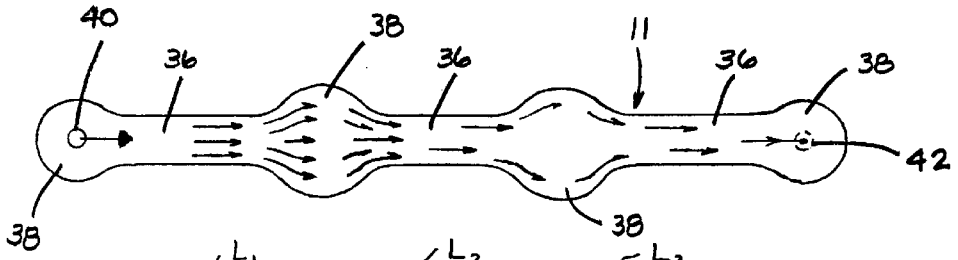
FIG. 5 is a diagrammatic view of an embodiment of the present invention cooling microcircuit.

FIG. 5 shows an alternative embodiment of the present microcircuit 10 in which the passage includes four chambers 38 and three segments 36 arranged in a substantially linear configuration. Passages 11 can assume a variety of configurations of segments 36 in series connected by chambers 38, and are not limited to the examples given here for explanation sake.

Figure 6:
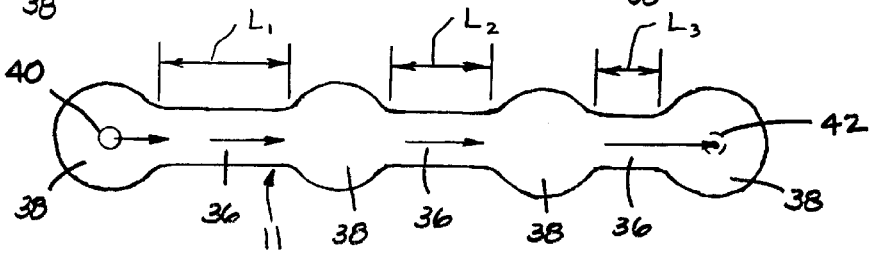
FIG. 6 is a diagrammatic view of an embodiment of the present invention cooling microcircuit.
Figure 7:
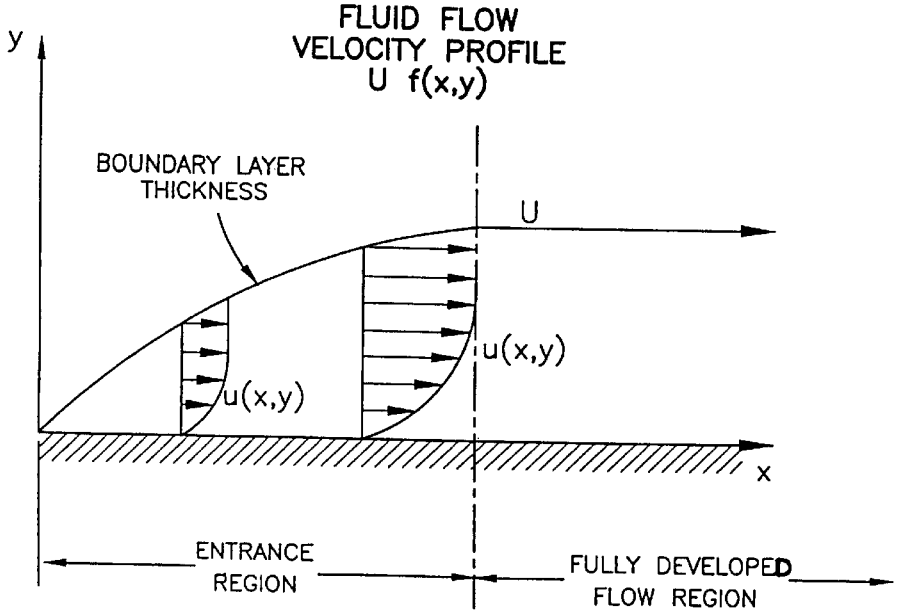
FIG. 7 is a fluid flow velocity profile chart illustrating a velocity profile having an entrance region followed by a fully developed region.

Referring to FIG. 6, in some embodiments the passage 11 includes a number of segments 36 successively shorter in length ($L_1>L_2>L_3$) connected by chambers 38. The longest of the successively shorter segments 36 communicates with the inlet aperture 40. At the inlet aperture 40, the temperature difference between the fluid temperature and the passage wall is greatest. The shortest of the successively shorter segments 36 communicates with the exit aperture 42. At the exit aperture 42, the temperature difference between the fluid temperature and the passage wall is smallest. Successively decreasing the length of the segments 36 within the passage 11 helps to offset the decrease in $\Delta T_{lm}$ in each successive segment 36. The successively decreased segment lengths positively influence the heat transfer rate by decreasing the influence of the exponential decaying temperature difference.

Referring to FIGS. 3 and 4, in some embodiments each successive segment 36 has a cross-sectional area greater than the prior or "upstream" segment 36 (e.g., the cross-sectional area for the second segment is greater than the cross-sectional area for the first segment). The increase in segment cross-sectional area ($A_{Sn}$) can, for example, be accomplished by holding the height (H) of the segments 36 constant and increasing the width ($W_n$) of the successive segments 36 ($A_{S1}<A_{S2}<A_{S3}<A_{S4}$, where $A_{Sn}=W_n \times H$). The change in cross-sectional area per segment 36 is chosen to create a substantially constant chamber pressure ($P_{Cn}$) ratio across each segment 36 for a given set of operating conditions (e.g., $P_{C1}/P_{C2} \approx P_{C2}/P_{C3}$). The substantially constant chamber pressure ratio across each segment 36 produces a cooling air velocity in each segment 36 that substantially equals the cooling air velocity in each other segment 36. As a result, the cooling air is metered substantially equally across each segment 36 rather than just across the inlet and exit apertures 40,42. As stated above, convective heat transfer is a function of the Reynolds number and therefore the Mach number of the cooling air traveling within a segment 36. The ability of the present microcircuit 10 to provide a cooling air velocity substantially equal in each segment 36 enables the microcircuit 10 to provide an optimum Mach number for a given set of operating conditions and therefore an optimum heat transfer for those operating conditions.

Under typical operating conditions within the turbine section of a gas turbine engine, the cooling air Mach number within the microcircuit will likely be in the vicinity of 0.3. With a Mach number in that vicinity, the entrance region within a typical segment 36 will likely extend somewhere between five and fifty diameters (diameter=the segment hydraulic diameter). Obviously, the length of the segment 36 will dictate what segment length percentage is characterized by velocity profile entrance region effects; e.g., a shorter segment will have an increased percentage of its length characterized by velocity profile entrance effects. Preferably, a segment 36 within the present microcircuit 10 will have at have least fifty percentage of its length devoted to entrance region effects.

For any given set of operating conditions, each of the above described microcircuit 10 embodiments will provide a particular heat transfer performance. It may be advantageous, therefore, to use more than one embodiment of the present microcircuit in those applications where the thermal profile of the wall to be cooled is non-uniform. The microcircuits 10 can be distributed to match and offset the non-uniform thermal profile of the wall 12 and thereby increasing the cooling efficiency of the wall 12.

Although this invention has been shown and described with respect to the detailed embodiments thereof, it will be understood by those skilled in the art that various changes in form and detail thereof may be made without departing from the spirit and the scope of the invention. For example, the detailed description above gives the preferred embodiment wherein the chamber pressure ratio across each segment in a passage is substantially equal to the chamber pressure ratio across other segments within the passage. In some instances, however, it may advantageous to vary the chamber pressure ratios across segments within a passage to suit the cooling application at hand.

What is claimed is:

1. An airfoil, comprising:

a cavity;

a wall surrounding said cavity; and at least one cooling air passage disposed in said wall, a microcircuit having a plurality of segments connected in series by one or more chambers, wherein each said segment has a cross-sectional flow area less than a cross-sectional flow area of said chambers;

wherein an inlet aperture connects said passage to said cavity, and an exit aperture connects said passage to a region outside said airfoil; and wherein cooling air within said cavity enters said passage through said inlet aperture and exits said passage through said exit aperture.

2. The airfoil of claim 1, wherein said cooling air passage occupies a wall surface area no greater than 0.1 square inches.

3. The airfoil of claim 1, wherein said cooling air passage occupies a wall surface area no greater than 0.06 square inches.

4. The airfoil of claim 1, wherein each said segment has a cross-sectional area no greater than 0.001 square inches.

5. The airfoil of claim 4, wherein each said segment has a cross-sectional area no greater than 0.0006 square inches and no less than 0.0001 square inches.

6. The airfoil of claim 1, further wherein each successive segment, beginning with an initial segment and ending with a final segment, has a cross-sectional flow area greater than any upstream said segment.

7. The airfoil of claim 6, wherein said plurality of segments include a first and third segment positioned substantially parallel to one another, a second segment extending between said first and third segments substantially perpendicular to said first and third segments, and a fourth segment extending in between said first and third segments.

8. The airfoil of claim 1, further wherein each successive segment, beginning with an initial segment and ending with a final segment, has a length shorter than any upstream said segment.

9. An airfoil, comprising:

a cavity;

a wall;

at least one cooling air passage disposed in said wall, said passage having a plurality of segments, including an initial segment and a final segment, connected in series by one or more chambers, an inlet aperture that connects said initial segment to said cavity, and an exit aperture that connects said final segment to a region outside said airfoil;

wherein each said segment, beginning with said initial segment and ending with said final segment, has a cross-sectional flow area greater than any upstream said segment.

10. An airfoil, comprising:

a cavity;

a wall surrounding said cavity; and at least one cooling air passage disposed in said wall, said passage having a plurality of segments connected in series by one or more chambers;

wherein an inlet aperture connects said passage to said cavity, and an exit aperture connects said passage to a region outside said airfoil;

wherein said segments are sized relative to one another such that during operation a ratio of chamber pressures is present across each said segment, and said ratio of chamber pressures across each said segment are substantially equal to one another.

11. The airfoil of claim 10, further wherein each successive segment, beginning with an initial segment and ending with a final segment, has a cross-sectional flow area greater than any upstream said segment.

12. An airfoil, comprising:

a cavity;

a wall surrounding said cavity;

at least one cooling air passage disposed in said wall, said passage having a plurality of alternately disposed segments and chambers;

an inlet aperture connecting said passage to said cavity; and an exit aperture connecting said passage to a region outside said airfoil;

wherein said chambers and said segments are relatively sized such that each said segment meters cooling airflow passing between a pair of said chambers.

13. A coolable wall for use in a gas turbine engine, said wall having a first side and a second side, comprising:

at least one cooling air passage disposed in said wall, said passage having a plurality of segments connected in series by one or more chambers, wherein each said passage segment has a cross-sectional flow area less than a cross-sectional flow area of said chambers;

an inlet aperture connecting said passage to said first side of said wall; and an exit aperture connecting said passage to said second side of said wall;

wherein cooling air on said first side of said wall may enter said passage through said inlet aperture and pass though to said second side of said wall through said exit aperture.

14. The coolable wall of claim 13, further wherein each successive segment has a cross-sectional flow area greater than any upstream said segment.

15. The coolable wall of claim 13, further wherein each successive segment has a length shorter than any upstream said segment.

16. A coolable wall having a first side and a second side for use in a gas turbine engine, comprising:

at least one cooling air passage disposed in said wall, said passage having a plurality of segments connected in series by one or more chambers;

an inlet aperture connecting said passage to said first side; and an exit aperture connecting said passage to said second side;

wherein each said segment, beginning with said initial segment and ending with said final segment, has a cross-sectional flow area greater than any upstream said segment.

17. A coolable wall, comprising:

at least one cooling air passage disposed in said wall, said passage having a plurality of segments connected in series by one or more chambers;

wherein an inlet aperture connects said passage to a first side of said wall, and an exit aperture connects said passage to a second side of said wall;

wherein said segments are sized such that during operation of said cooling passage a ratio of chamber pressures is present across each said segment, and said ratio of chamber pressures across each said segment are substantially equal to one another.

18. The coolable wall of claim 17, further wherein each successive segment has a cross-sectional flow area greater than any upstream said segment.

19. A coolable wall, comprising:

at least one cooling air passage disposed in said wall, said passage having a plurality of alternately disposed segments and chambers;

an inlet aperture connecting said passage to a first side of said wall; and an exit aperture connecting said passage to a second side of said wall;

wherein said chambers and said segments are relatively sized such that each said segment meters cooling airflow passing between a pair of said chambers.

20. A method for cooling a wall for use in a gas turbine engine, comprising the steps of:

providing a cooling air passage disposed in said wall, said passage having a plurality of alternately disposed segments and chambers, an inlet aperture connecting said passage to a first side of said wall, and an exit aperture connecting said passage to a second side of said wall;

metering cooling air flow in each said segment extending between a pair of said chambers.

21. A method for cooling a wall for use in a gas turbine engine, comprising the steps of:

providing a cooling air passage disposed in said wall, said passage having a plurality of alternately disposed segments and chambers, an inlet aperture connecting said passage to a first side of said wall, and an exit aperture connecting said passage to a second side of said wall;

providing cooling airflow though said cooling air passage;

metering said cooling airflow in said segments;

creating a chamber pressure ratio across each said segment, wherein said chamber pressure ratios across said segments are substantially equal to one another.

* * * * *